US005660022A

United States Patent [19]

Lade et al.

[11] Patent Number: 5,660,022

[45] Date of Patent: Aug. 26, 1997

[54] APPARATUS FOR PUSHING BAG PACKAGES OR SIMILAR COMPLIANT ARTICLES INTO FOLDING BOXES

[75] Inventors: Guenther-Eberhard Lade, Berglen; Walter Dietrich; Eberhard Krieger, both of Weinstadt; Siegfried Weber, Rudersberg; Richard Kerth, Schwäbisch Hall, all of Germany

[73] Assignee: Robert Bosch GmbH, Stuttgart, Germany

[21] Appl. No.: 591,429

[22] PCT Filed: Jul. 9, 1994

[86] PCT No.: PCT/DE94/00796

§ 371 Date: Jan. 22, 1996

§ 102(e) Date: Jan. 22, 1996

[87] PCT Pub. No.: WO95/03219

PCT Pub. Date: Feb. 2, 1995

[30] Foreign Application Priority Data

Jul. 22, 1993 [DE] Germany ..... 9310969 U

[51] Int. Cl.[6] ..... B65B 35/20

[52] U.S. Cl. ..... 53/252; 53/258; 53/566

[58] Field of Search ..... 53/258, 261, 255, 53/566, 252, 251, 530, 529, 439

[56] References Cited

U.S. PATENT DOCUMENTS

| | | | |
|---|---|---|---|
| 2,644,625 | 7/1953 | Currivan | 53/252 |
| 3,269,091 | 8/1966 | Martin | 53/252 |
| 4,054,019 | 10/1977 | Weichhand et al. | 53/252 X |
| 4,211,054 | 7/1980 | Sramek | 53/252 X |
| 4,562,692 | 1/1986 | Scarpa et al. | 53/566 |
| 4,578,927 | 4/1986 | Scarpa et al. | 53/252 X |
| 4,982,556 | 1/1991 | Tisma | 53/252 X |

*Primary Examiner*—James F. Coan

*Attorney, Agent, or Firm*—Edwin E. Greigg; Ronald E. Greigg

[57] ABSTRACT

An apparatus for pushing bag packages or similar compliant articles into folding boxes which includes first and second endless conveying devices. Open folding boxes are conveyed on the first conveying device to a bag filling station and the bag packages are conveyed in the region of the filling section in alignment with the folding boxes by the second conveying device. For pushing the bag packages into the folding boxes, a pusher rod in combination with a pivotably arranged lever having a covering tongue are used. Guiding the lever by a contact-pressure element and guide member achieves low loading on the bag packages which permits a simple construction of the apparatus.

20 Claims, 3 Drawing Sheets

APPARATUS FOR PUSHING BAG PACKAGES OR SIMILAR COMPLIANT ARTICLES INTO FOLDING BOXES

PRIOR ART

The invention relates to an apparatus for pushing bag packages or similar compliant articles into folding boxes. In the case of a known apparatus of this type, the packable-article cartons and the drivers for the folding boxes are arranged on endless conveying devices. For the pushing-in operation, use is made of pushers which can be moved parallel and transversely to the conveying direction of the packable-article cartons and of the folding boxes. In order to make it possible to push into folding boxes bag packages whose deformable cross-sectional area is partially larger than the cross section of the opening of the folding boxes, the pushers are assigned covering tongues which are coupled to a push rod such that they can be moved in the push-in direction independently of said pushers. During the pushing-in operation, the covering tongues first of all press the bag packages in the packable-article cartons downwards and then, after entering into the opening of the folding boxes, cause the upper wall of said folding boxes to bulge upwards.

The disadvantage with the known apparatus is that the introduction of force into the covering tongue takes place in the vicinity of its axis of rotation in the push rod, with the result that, due to the leverages, high forces are necessary in order to transmit, in particular, the desired pressing force for the bag package. This means that the apparatus is complex and expensive.

ADVANTAGES OF THE INVENTION

In contrast, the apparatus according to the invention has the advantage that the introduction of the pressing force, for compressing the bag package, into the covering tongue, takes place directly in the region of overlap between the covering tongue and the bag package by means of a contact-pressure member and a guide rail. Consequently, the necessary transmission forces in the covering tongue and its mount are reduced, as a result of which the apparatus is straightforward and inexpensive. Furthermore, a suitable arrangement of guide rails and supporting rollers makes it possible to achieve any desired pivot movement of the covering tongue. Consequently, the apparatus according to the invention can be adapted in a simple manner to various formats of bag packages and of folding boxes.

Further advantages of the apparatus according to the invention are given in the subclaims and the description hereinafter. The apparatus according to the invention can be particularly simply adapted to various formats of bag packages and of folding boxes if the guide rails are configured to be vertically adjustable. In order to increase the operational reliability of the apparatus according to the invention it is, furthermore, proposed to couple an overload sensor to the guide rail for compressing the bag package. The sensor detects if, for example, there are two bag packages in a packable-article carton instead of one or if a bag package has been wrongly inserted into the packable-article carton.

BRIEF DESCRIPTION OF THE DRAWINGS

An exemplary embodiment of the invention is represented in the drawings and is explained in more detail in the following description.

DETAILED DESCRIPTION OF THE EXEMPLARY EMBODIMENT

Figure 1:
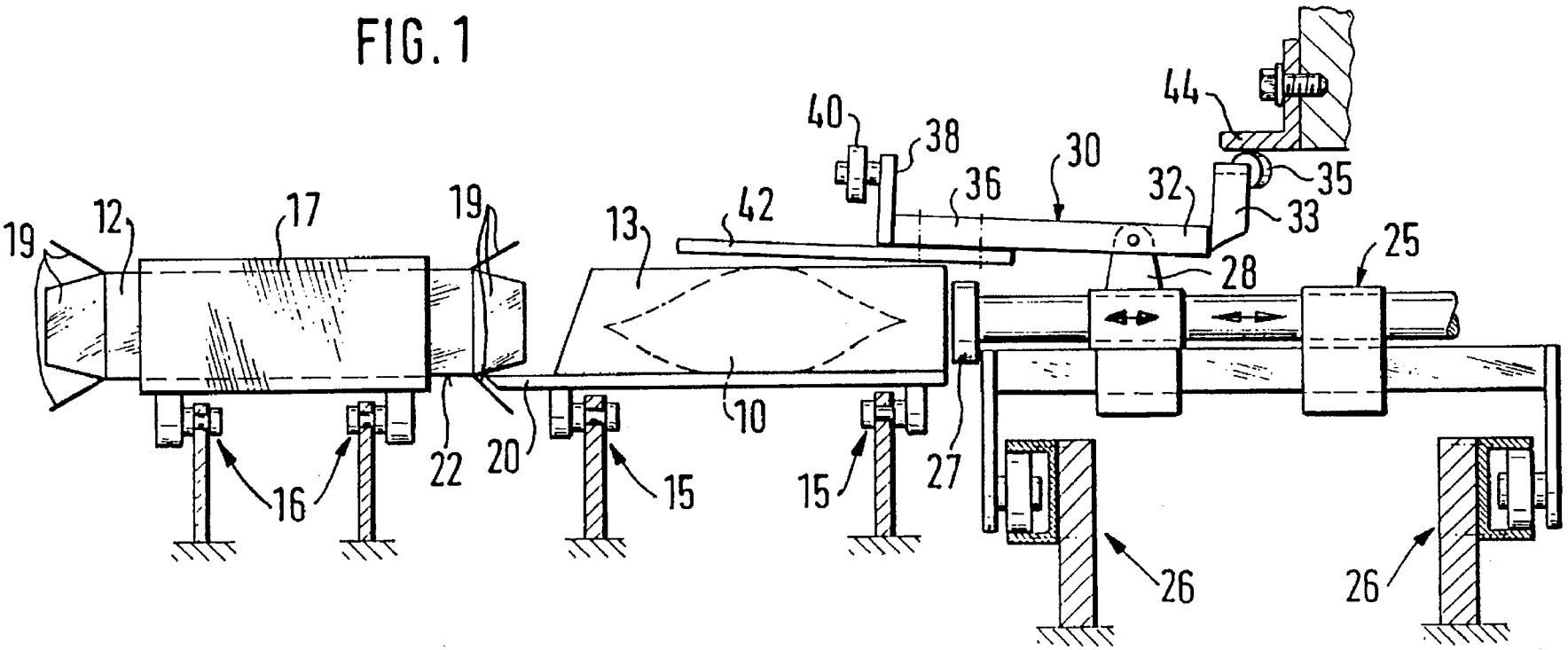
FIGS. 1 to 3 show, in a simplified manner, cross sections of an apparatus for pushing bag packages or similar compliant articles into folding boxes during different operating phases.

The apparatus for pushing bag packages 10 or similar compliant articles into folding boxes 12 has packable-article cartons 13 for receiving in each case one bag package 10, the latter being conveyed into the packable-article cartons 13 via conveying means (not shown) outside the apparatus. The packable-article cartons 13 are fastened on an endless conveyor, for example a chain conveyor 15. The cross-sectional areas of the packable-article cartons 13 are matched to the cross section of the opening of the folding boxes 12. A second chain conveyor 16 for the folding boxes 12 is arranged, parallel to the first chain conveyor 15, in the same plane in the apparatus. The chain conveyor 16 has drivers 17 for open folding boxes 12. When the folding boxes 12 are broken open and transferred to the drivers 17 outside the apparatus, their folding flaps 19 are simultaneously bent back, releasing the cross section of the opening in the process. The spacing between the packable-article cartons 13 and the drivers 17 is identical, with the result that in each case one packable-article carton 13 and one pair of drivers move one beside the other in the apparatus.

In the filling region of the folding boxes 12, the packable-article cartons 13 are each assigned a combined pressing and pushing-in device 25.

These are likewise coupled to an endless conveying device 26, which, in the filling region, has a conveying section parallel to the chain conveyors 15, 16 for the packable-article cartons 13 and the drivers 17. The pressing and pushing-in device 25 has a pusher 27, which can he moved in the push-in direction of the bag packages 10, and, above, a tongue retainer 28 which can be moved in the push-in direction independently of said pusher. A pivotable lever 30 is arranged in an off-centre position on the tongue retainer 28. On the short arm 32 of the lever 30, a supporting roller 35 is fastened obliquely in the conveying direction via an angle piece 33. On the long arm 36 of the lever 30, a second supporting roller 40 is fastened, with the axis of rotation perpendicular to the conveying direction of the packable-article cartons 13, via a further angle piece 38. A covering tongue 42 is fastened beneath the long arm 36, on the side of the packable-article cartons 13, approximately centrally with respect to the supporting roller 40.

The plate-like covering tongue 42 is narrower than the upper opening of the packable-article carton 13, with the result that the covering tongue 42 can penetrate into the packable-article cartons 13 and can press flat the bag package 10 located therein.

Three guide rails 44 to 46 are arranged above the pressing and pushing-in device 25, in the vicinity of the movement area thereof. In the section of the apparatus in which the packable-article cartons 13 pass into the apparatus (FIG. 1), there is arranged a vertically adjustable guide rail 44 which acts, with its underside, on the supporting roller 35 on the short arm 32 of the lever 30. The guide rail 44 has a negative gradient in the conveying direction, with the result that the covering tongue 42 is raised up and, in particular, can project beyond the bag package 10 toward the pusher 27.

Figure 2:
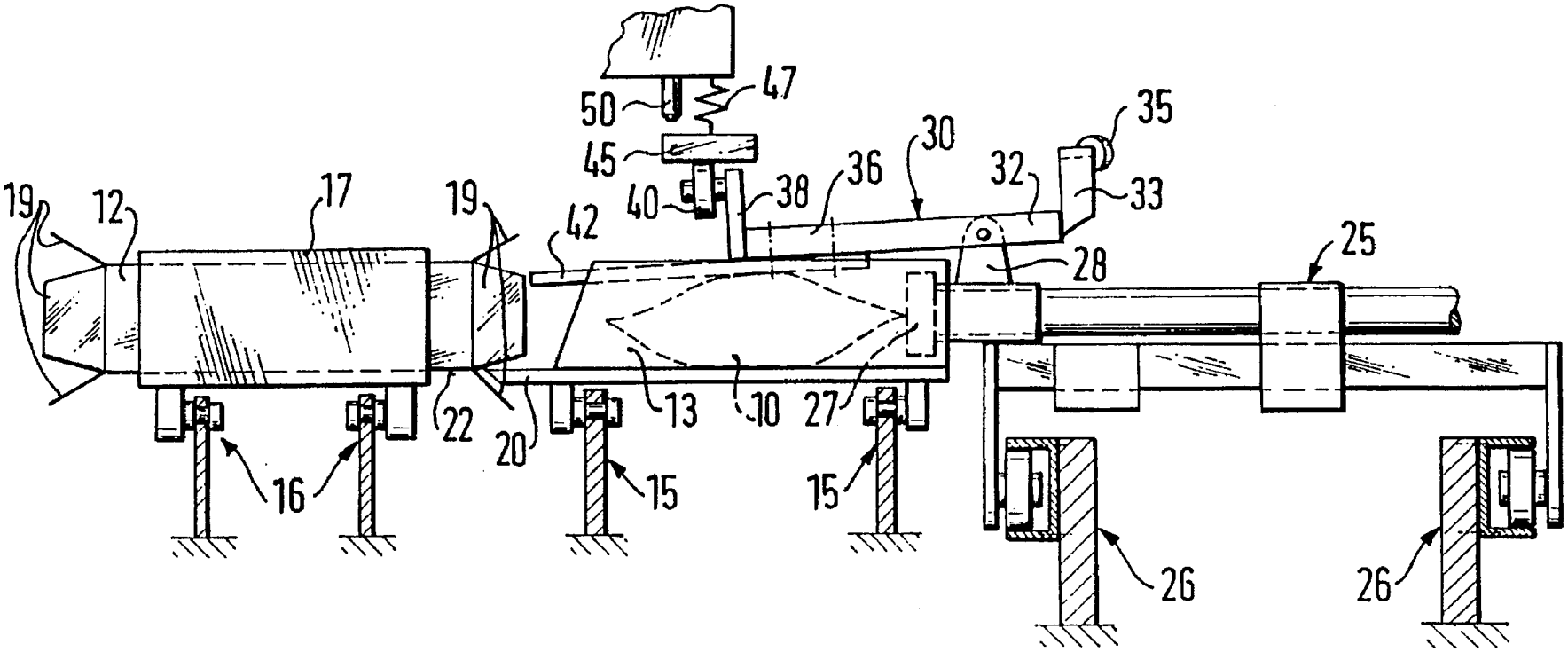
Figure 3:
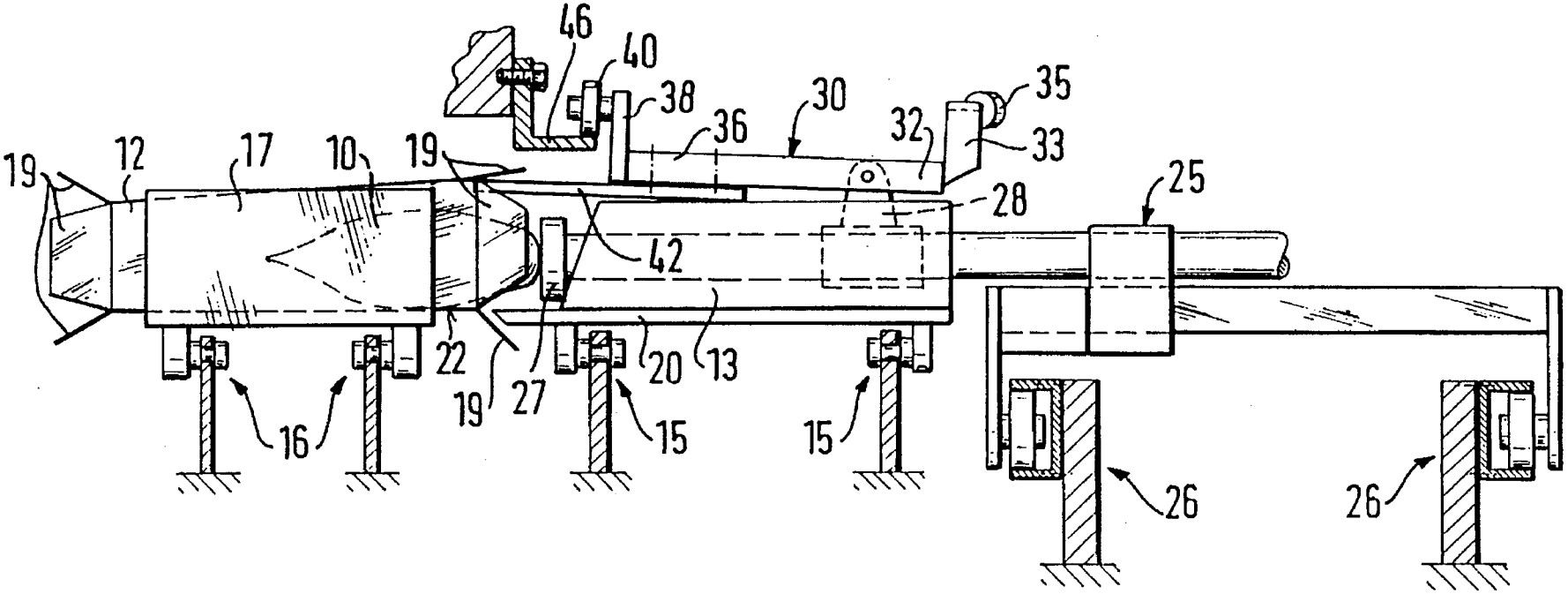

In the central section of the apparatus (FIG. 2), in which section the covering tongue 42 is located above the bag package 10, there is arranged a second vertically adjustable guide rail 45, the underside of which acts on the supporting roller 40. The guide rail 45 likewise has a negative gradient in the conveying direction, with the result that, when the supporting roller 40 rolls on the guide rail 45, the covering tongue 42 is pressed downwards. A pressure-activated overload sensor 50 is coupled to the guide rail 45 via a spring 47. Following the guide rail 45 is a vertically adjustable third guide rail 46 (FIG. 3). The guide rail 46 acts on the underside of the supporting roller 40 and has a positive gradient in the conveying direction, with the result that the covering tongue 42 is raised.

The inventive apparatus for pushing bag packages 10 or similar compliant articles into folding boxes 12 functions as follows:

When a folding box 12 and the associated packable-article carton 13 enter into the filling region of the apparatus, the pressing and pushing-in device 25, which is first of all located in a retracted position, is displaced in the direction of the packable-article carton 13 by means of its conveying device 26. The supporting roller 35 comes into contact with the first guide rail 44 and, in the course of further movement, is pressed downwards by the same, with the result that the covering tongue 42 is raised (FIG. 1). As the covering tongue 42 enters into the region of the packable-article carton 13, the covering tongue 42 is raised to such an extent that it gradually covers over the bag package 10 without coming into contact therewith. The pusher 27 is likewise moved in the direction of the bag package 10 until, finally, it touches the same without, however, displacing it in the packable-article carton 13. Once the pressing and pushing-in device 25 has been fully advanced up to the packable-article carton 13, the bag package 10 is fully covered over by the covering tongue 42, and the supporting roller 35 passes out of the region of the first guide rail 44. Thereafter, the covering tongue 42 is lowered onto the bag package 10. The supporting roller 40 is then acted upon by the second guide rail 45 and is pressed downwards by the same (FIG. 2). Consequently, the bag package 10 is gradually compressed by the covering tongue 42 until its height is lower than that of the folding boxes 12. Should there be, for example, two bag packages 10 in a packable-article carton 13 instead of one or if a bag package 10 has been wrongly inserted into the packable-article carton 13, then the counterforce of the supporting roller 40 on the guide rail 45 increases. The spring 47 is consequently compressed and the overload switch 50 switches the apparatus off.

The operation of pushing the bag package 10 into the folding box 12 then begins by the pusher 27 being moved in the direction of the folding box 12. Since, in the filling region, the base 22 of the folding box 12 is displaced with respect to the base 20 of the packable-article carton 13, the bag package 10 can be pushed into the folding box 12 without difficulty. In order further to facilitate the pushing-in operation, it is provided that the folding box 12 is made to bulge vertically by its upper wall being raised somewhat. For this purpose, the covering tongue 42, which has been advanced close up to the folding line of the upper covering flap 19, is raised somewhat. This takes place in that the supporting roller 40 is acted upon by the third guide rail 46 and moved upwards (FIG. 3). The cross section of the opening of the folding box 12 is increased vertically by the upper wall of the folding box being raised, with the result that the friction between the upper side of the bag package 10 and the upper folding-box side is reduced or avoided. Once the bag package 10 has been fully pushed into the folding box 12 by the pusher 27, the pusher 27 and the covering tongue 42 of the pressing and pushing-in device 25 are moved back. The pressing and pushing-in device 25 is then displaced back to the beginning of the apparatus, by its conveying device 26, on a loop-like path in order to push in the next bag package 10. The folding box 12 which has been filled then passes into the region of a closing device, where it is closed on each end.

In addition, it should be pointed out that the three guide rails 44 to 46 can be replaced by a single guide rail which, for example, encloses the supporting roller 40 in a groove-like manner. This means that the accessibility, which is already good in any case, of the apparatus in the region of the pressing and pushing-in device 25 is further improved. It is also possible, in the case of bag packages 10 which can be pushed in without difficulty, to dispense with the step of the upper folding-box wall being raised by the covering tongue 42, and thus with the third guide rail 46. In this case, the covering tongue 42 is merely advanced up to the upper folding-box wall. By a corresponding adjustment of the guide rail 45 for compressing the bag package 10, the covering tongue 42 should, in this case, however be lowered to beneath the upper folding-box wall.

The foregoing relates to preferred exemplary embodiment of the invention, it being understood that other variants and embodiments thereof are possible within the spirit and scope of the invention, the latter being defined by the appended claims.

We claim:

1. An apparatus for pushing bag packages (10) or similar compliant articles into folding boxes (12), comprising a first endless conveying device (16) which conveys the folding boxes (12) on a conveying section, a second endless conveying device (15) operable in parallel with said first endless conveying device having packable-article cartons (13) which are matched to a cross section of the opening of the folding boxes (12) to received the bag packages (10), pushers (27) which operate in alignment with the packable-article cartons (13) in the region of the filling section and which are moved in the push-in direction of the bag packages (10), and tongue retainers (28) which circulate in alignment with the pushers (27) likewise above the filling section, said tongue retainers are moved in the push-in direction independently of the pushers and have arranged thereon a covering tongue (42) which is directed towards a folding box (12), the covering tongue (42) is forced by a contact-pressure element (40) in the region of overlap with the bag package (10), and the covering tongue (42) is connected to the tongue retainer of a pivotable lever (30).

2. The apparatus as claimed in claim 1, wherein the contact-pressure element (40) is assigned to at least one guide member (45, 46) arranged in a vicinity of the movement area of the covering tongue (42).

3. The apparatus as claimed in claim 2, wherein the guide member is a guide rail (45, 46).

4. The apparatus as claimed in claim 2, wherein the guide rails (44, 45) are vertically adjusted.

5. The apparatus as claimed in claim 3, wherein the guide rails (44, 45) are vertically adjusted.

6. The apparatus as claimed in claim 1, wherein the contact-pressure element is a supporting roller (40).

7. The apparatus as claimed in claim 2, wherein the contact-pressure element is a supporting roller (40).

8. The apparatus as claimed in claim 3, wherein the contact-pressure element is a supporting roller (40).

9. The apparatus as claimed in claim 4, wherein the contact-pressure element is a supporting roller (40).

10. The apparatus as claimed in claim 5, wherein the contact-pressure element is a supporting roller (40).

11. The apparatus as claimed in claim 1, wherein an overload sensor (50) is arranged on a guide rail (45) for determining a pressure exerted on the bag packages (10).

12. The apparatus as claimed in claim 2, wherein an overload sensor (50) is arranged on a guide rail (45) for determining a pressure exerted on the bag packages (10).

13. The apparatus as claimed in claim 3, wherein an overload sensor (50) is arranged on a guide rail (45) for determining a pressure exerted on the bag packages (10).

14. The apparatus as claimed in claim 4, wherein an overload sensor (50) is arranged on a guide rail (45) for determining a pressure exerted on the bag packages (10).

15. The apparatus as claimed in claim 5, wherein an overload sensor (50) is arranged on a guide rail (45) for determining a pressure exerted on the bag packages (10).

16. The apparatus as claimed in claim 6, wherein an overload sensor (50) is arranged on a guide rail (45) for determining a pressure exerted on the bag packages (10).

17. The apparatus as claimed in claim 7, wherein an overload sensor (50) is arranged on a guide rail (45) for determining a pressure exerted on the bag packages (10).

18. The apparatus as claimed in claim 8, wherein an overload sensor (50) is arranged on a guide rail (45) for determining a pressure exerted on the bag packages (10).

19. The apparatus as claimed in claim 9, wherein an overload sensor (50) is arranged on a guide rail (45) for determining a pressure exerted on the bag packages (10).

20. The apparatus as claimed in claim 10, wherein an overload sensor (50) is arranged on a guide rail (45) for determining a pressure exerted on the bag packages (10).

* * * * *